United States Patent [19]

Zansky

[11] Patent Number: 4,612,479

[45] Date of Patent: Sep. 16, 1986

[54] FLUORESCENT LIGHT CONTROLLER

[75] Inventor: Zoltan Zansky, Willowdale, Canada

[73] Assignee: Honeywell Inc., Minneapolis, Minn.

[21] Appl. No.: 632,787

[22] Filed: Jul. 20, 1984

[51] Int. Cl.[4] ..... G05F 1/00; H05B 37/02; H05B 39/04; H05B 41/36

[52] U.S. Cl. ..... 315/194; 315/DIG. 4; 315/198; 315/205

[58] Field of Search ..... 315/DIG. 4, DIG. 5, 315/194, 198, 199, 205, 195

[56] References Cited

U.S. PATENT DOCUMENTS

| | | | |
|---|---|---|---|
| 3,222,572 | 12/1965 | Powell, Jr. | 315/151 |
| 3,265,930 | 8/1966 | Powell, Jr. | 315/209 |
| 3,355,657 | 11/1967 | Biet et al. | 323/22 |
| 3,414,768 | 12/1968 | Peek, Jr. | 315/194 X |
| 3,935,505 | 1/1976 | Spiteri | 315/194 |
| 4,321,508 | 3/1982 | Adler et al. | 315/199 |
| 4,350,935 | 9/1982 | Spira et al. | 315/DIG. 4 |
| 4,358,716 | 11/1982 | Cordes et al. | 315/DIG. 4 |
| 4,491,903 | 1/1985 | Montague | 333/181 |
| 4,527,099 | 7/1985 | Capewell et al. | 315/205 |

*Primary Examiner*—Saxfield Chatmon
*Attorney, Agent, or Firm*—Charles G. Mersereau

[57] ABSTRACT

A dimming system for fluorescent lamps is disclosed which includes a first switching means connected to said source terminals and to said load terminals for controlling the supply of power to said load terminals, a switch control connected to switching means for modulating said load terminals to modulate the sinusoidal power on a time ratio variable basis in order to supply a variable amount of power to said load terminals; and an inverting reducing transformer connected to said source terminals between said source terminals and a second switch means.

7 Claims, 5 Drawing Figures

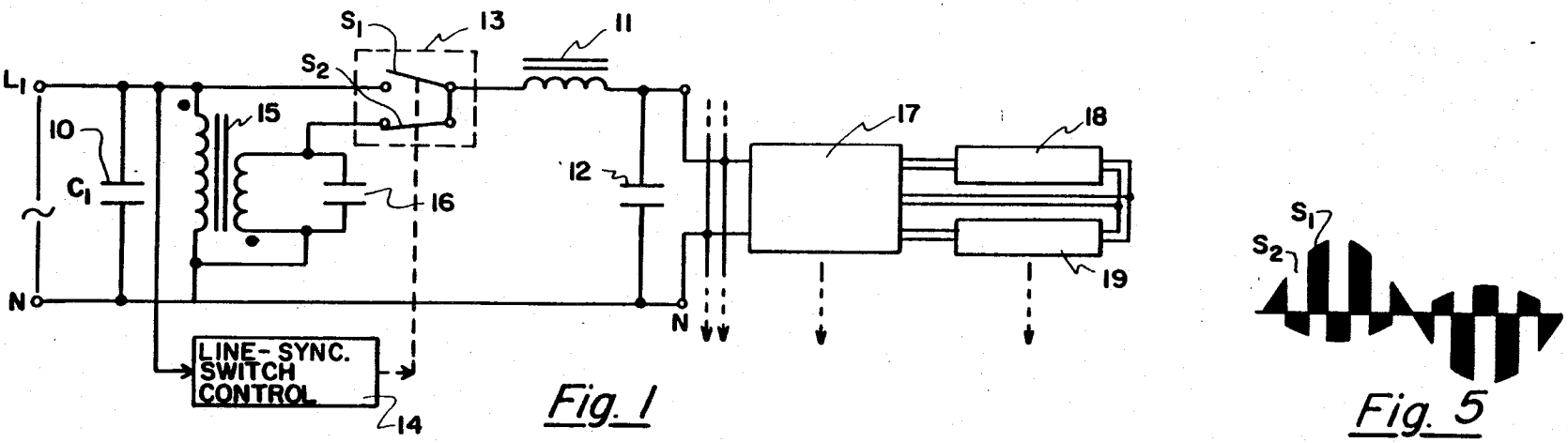
Fig. 1
Fig. 5
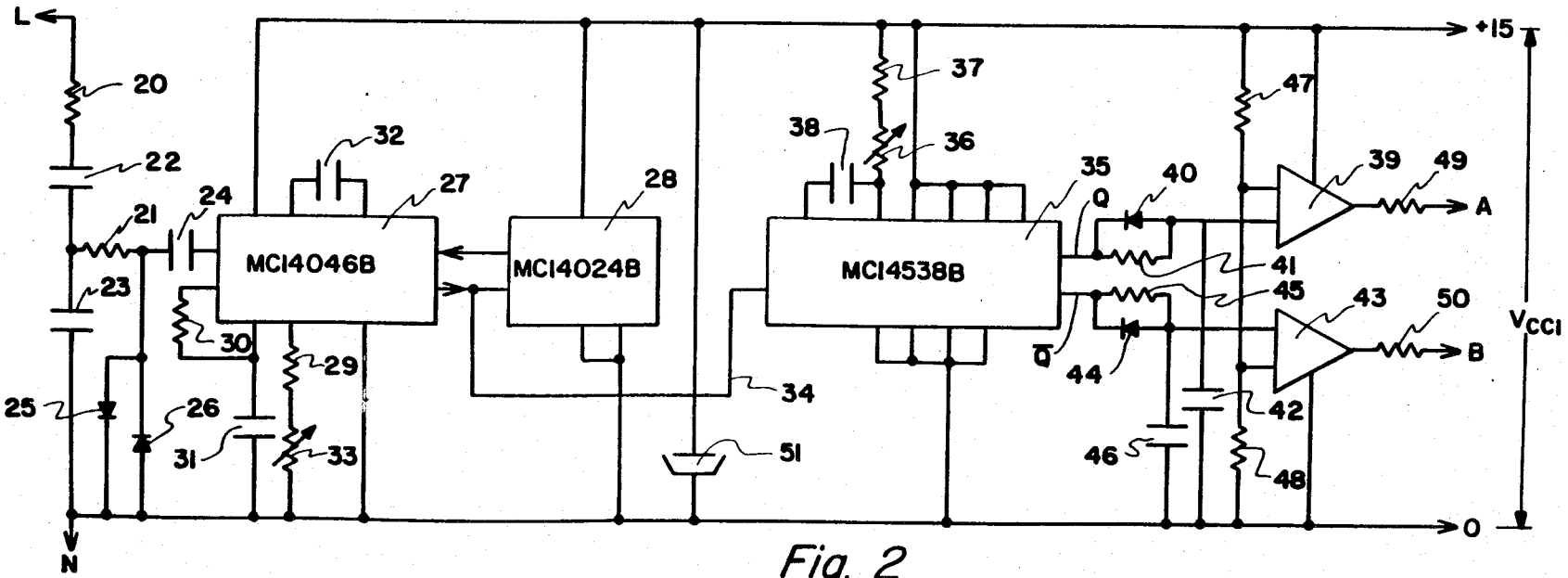
Fig. 2

FLUORESCENT LIGHT CONTROLLER

BACKGROUND OF THE INVENTION

1. Field of the Invention

The present invention relates generally to a controller for fluorescent tubes and, more particularly, to a fluorescent lamp dimming system for use with a standard "rapid start" ballast system. The system of the invention uses a switching circuit to modulate the main AC line input in a manner which preserves cathode heater voltage during dimming and maintains reasonably clear sinusoidal line current without affecting the power factor.

2. Description of the Prior Art

In the prior art most controllers of inductive fluorescent lighting loads have energized these loads at a variable phase angle turn on point and allowed natural commutation, i.e. the zero crossover point in the current and/or voltage cycle, to switch off the load. Other controllers have turned the fluorescent lighting loads on at the zero crossover point and have turned the loads off at a selected phase angle to yield the desired amount of lighting control.

Phase angle turn on controllers, i.e. controllers of the first type described above, which power rapid start ballast fluorescent lighting systems have a very limited control range because the regulatory effect of the choke-capacitor components in the ballast tends to counteract any change in RMS load voltage and because there is a rapid drop in fluorescent tube heater voltages as the angle of turn on is increased.

Phase angle turn off controllers, i.e. controllers of the second type, produce a stronger counter electromotive force spike from the rapid start ballast inductance. This spike causes severe acoustic noise and break down of circuit components. Prior art devices have heretofore suppressed this spike with some loss of power. However, rapid start ballast circuits connected to a turn off type of controller employing spike suppression experience low fluorescent tube heater voltages at lower dimming levels resulting in a reduced dimming range.

Thus, in the prior art generally it has not been possible to achieve effective and reliable dimming control of rapid start fluorescent ballast lighting systems because the reduced operating voltages imposed upon the fluorescent tube electrodes at lower light levels causes poor tube ignition, causes premature tube drop out, and lessens tube life due to cathode stripping. The regulator effect offered by the series connected choke and capacitor arrangement in the rapid start ballast opposes attempts to control or modulate the ballast AC input. Extremely high amplitude counter electromotive forces or flyback spikes resulting from the turn off control of rapid start ballast systems causes unacceptable ballast acoustic noise levels, causes poor fluorescent tube crest factors, and endangers circuit components. A further disadvantage of existing control methods is that low light levels are susceptible to light intensity changes caused by line voltage changes.

One invention contained in U.S. patent application Ser. No. 548,523, filed Nov. 3, 1983 and assigned to the same assignee as the present invention overcomes some of the difficulties of the prior art. That invention relates to a system wherein the counter electromotive switching spikes generated as a result of phase turn off of a reactive type load such as that found with respect to fluorescent tubes are converted into power pulses which are utilized during switch off intervals to achieve corrective work functions such as maintaining the filaments of a fluorescent tube heated during the switch off intervals.

That system, however, while it does increase the turndown range for dimming while maintaining required cathode heating voltage, it does not reach the desired combination of maintaining cathode heater voltage during full range dimming, i.e. from 100% to about 10% output, together with the provision of a reasonably clean sinusoidal line current having a good power factor.

SUMMARY OF THE INVENTION

By means of the present invention there is provided a fluorescent tube dimming control circuit which is especially useful with rapid start ballast systems and which achieves full range (100%–10%) dimming with a minimum of distortion of the sinusoidal line voltage input and power factor loss. The dimming control of the invention includes a switching circuit and a control circuit which cooperate to modulate the sinusoidal line voltage supplied to the lamp ballast by time ratio modulation of the input wave at a frequency much higher than the line frequency. The control of the relative pulse widths of the high to low voltage of opposite polarity ON and OFF portions of the switching cycle controls the average power to the fluorescent lamps.

BRIEF DESCRIPTION OF THE DRAWINGS

In the drawings:

FIG. 1 is a general schematic diagram of a fluroescent lamp system utilizing the dimming controller of the invention;

FIG. 2 is a schematic circuit diagram of the line synchronized switch control of FIG. 1;

FIG. 5 illustrates the supply voltage wave form.

Figure 3:
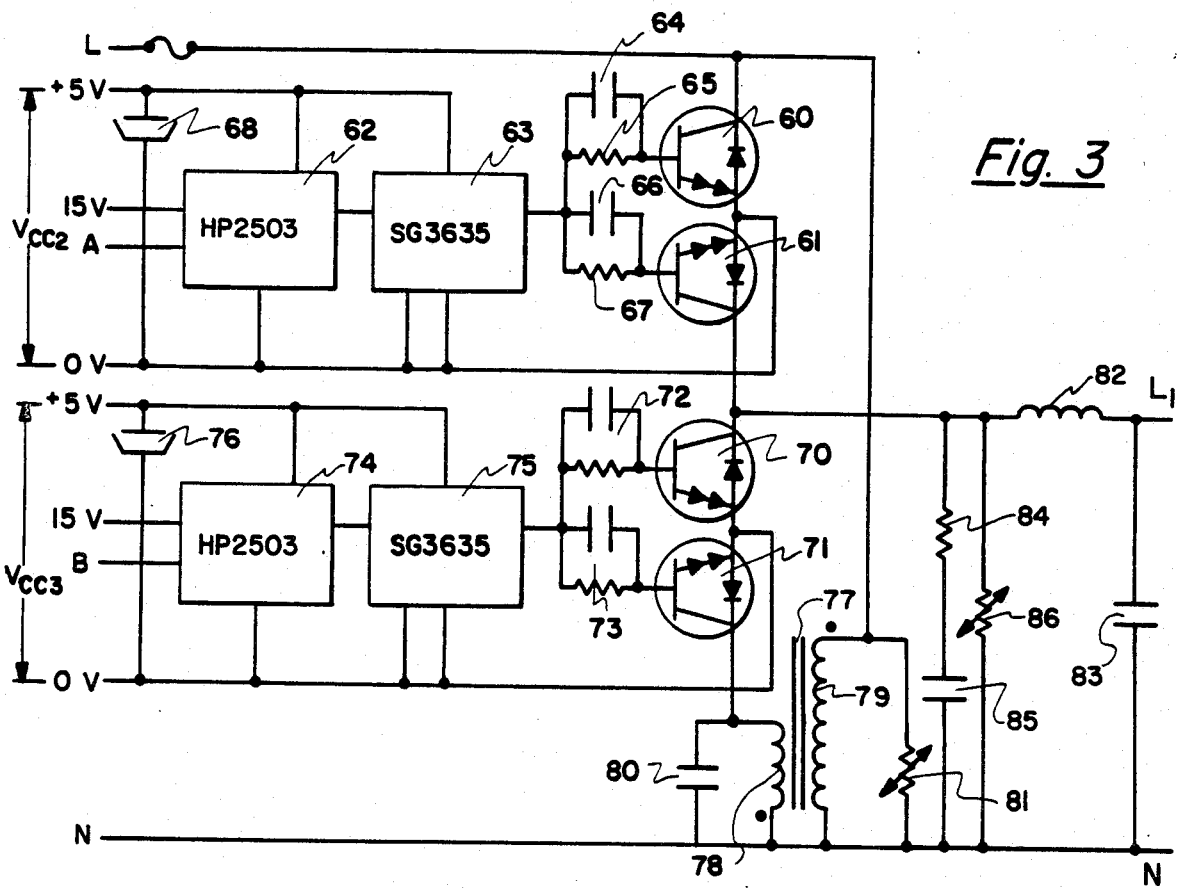
FIG. 3 is a schematic circuit diagram of the switch system of FIG. 1.

The fluorescent lamp system of FIG. 1 includes AC sinusoidal power source connections through line conductor $L_1$ and neutral conductor N; RFI filter capacitor 10, RFI filter choke coil 11 and RFI capacitor 12. The switching system of the invention including switches $S_1$ and $S_2$ is illustrated by the dashed line 13 and a line synchronous chopper or switching control is shown in block form at 14. A transformer 15 and further RFI suppression capacitor 16 are connected in series with $S_2$. The system further includes a conventional rapid start fluorescent lamp ballast 17 and fluorescent lamps 18 and 19. The broken lines with arrows indicate that the control system can be used for a plurality of ballasts operating from the same line power input.

The line synchronized switch control 14 is shown in greater detail in the schematic circuit diagram of FIG. 2. The switch control input includes resistors 20 and 21, capacitors 22, 23 and 24 and voltage limiting diodes 25 and 26. Resistors 20 and 21 together with capacitors 22 and 23 comprise a line frequency bandpass filter (normally 60 Hz) to prevent problems associated with the presence of power line disturbances. Integrated circuits (IC's) 27 and 28 which may be MC14046B and MC14024B integrated circuits available from Motorola together with resistors 29 and 30, capacitors 31 and 32 and potentiometer 33 provides a phase locked loop oscillator which raises the input frequency to the desired harmonic frequency which may be the eighth harmonic (normally 480 Hz). The input bandpass filter also provides filter synchronization of the phase locked loop of IC's 27 and 28 to the powerline.

The phase locked harmonic output is conducted via 34 to the triggering input of a variable pulse width one-shot IC 35 which may be an MC14538B one shot available from Motorola. The dimming of the lamps is controlled by potentiometer 36 which is associated with resistor 37 and capacitor 38.

The complimentary Q and $\overline{Q}$ outputs of the one shot 35 are ultimately used to drive the switches $S_1$ and $S_2$ as well be described below in conjunction with FIG. 3. The Q output of one shot 35 provides one input to a further IC comparator 39 through a dead-time delay circuit including diode 40, resistor 41 and capacitor 42. Similarly the $\overline{Q}$ output of one shot 35 is conducted as one input to IC comparator 43 via a dead-time delay circuit including diode 44, resistor 45 and capacitor 46. Other inputs to amplifiers are from power supplied from an isolated DC source $V_{CC1}$ as through resistors 47 and 48, respectively. The outputs based on Q and $\overline{Q}$ are fed through resistors 49 and 50 respectively to become the A and B control inputs for controlling switches $S_1$ and $S_2$ of FIG. 1 as described with reference to FIG. 3. A further power supply filter capacitor is provided at 51.

The switch system of FIG. 3 includes identical upper and lower portions. The upper portion represents $S_1$ and includes fast power transistors 60 and 61, which are turned ON and OFF by IC's 62 and 63, which may be HP2503 and SG3635 IC's respectively. A gate drive R-C circuit including capacitor 64 and resistor 65 is connected between transistor 60 and IC 63 and a similar R-C circuit including capacitor 66 and resistor 67 is associated with transistor 61. A power supply filter capacitor 68 and isolated DC source $V_{CC2}$ are also provided. The $S_2$ portion likewise includes transistors 70 and 71 with respective base drive R-C circuit 72 and 73, IC's 74 and 75, power supply filter capacitor 76 and isolated DC source $V_{CC3}$. The transistor 71 is connected to a transformer 77 having secondary 78, primary 79 and associated capacitor 80 and variable resistor 81.

The output of the switches $S_1$ (transistors 60 and 61) and $S_2$ (transistors 70 and 71) is connected to a standard rapid start ballasted fluorescent lamp branch circuit having $L_1$ and N terminals through a small low-pass radio frequency interference suppression choke 82 and capacitor 83. The transient voltage suppression circuit includes a snubber having resistor 84 and capacitor 85 and MOV variable resistor 86.

As shown in FIG. 1, the system operates such that switches $S_1$ and $S_2$ are alternately turned ON and OFF at a pulse width frequency in accordance with the amount of dimming required. The "dead-time" circuits shown in FIG. 2 associated with the Q and $\overline{Q}$ control outputs of IC 35 prevent the situation in which both $S_1$ and $S_2$ are ON at once. This assures that $S_1$ is reliably turned OFF before $S_2$ is turned ON or vice versa.

In operation, if it is assumed that the lamps are operating at full output, i.e. $P_B = 100\%$, the pulse width of $S_1$ will be essentially 100% and the pulse width of $S_2$ essentially 0%. The input to the lamps under this circumstance is essentially as though $S_1$ was continually closed or no controller was in the system. As the dimming potentiometer 36 (FIG. 2) is adjusted upward the pulse width of $S_1$ is decreased and that of $S_2$ increased. This produces a waveform of the type illustrated in FIG. 5 on line L. FIG. 5 shows the situation where both switches have a pulse width of approximately 50%. The black of course represents the closure of $S_1$ and the gaps, the closure of $S_2$. It should be noted that, although the power and average current value is diminished, amplitude of the voltage wave is not diminished the peak. There is, on the average, very little distortion from the sinusoidal form in either the line or lamp current. As the pulse width of $S_2$ is increased, it is seen by the ballast as more and more of the harmonic, nominally 480 Hz, signal and less of the line or 60 Hz signal. This modulation can also be described as partially suppressed carrier time ratio modulation.

Figure 4:
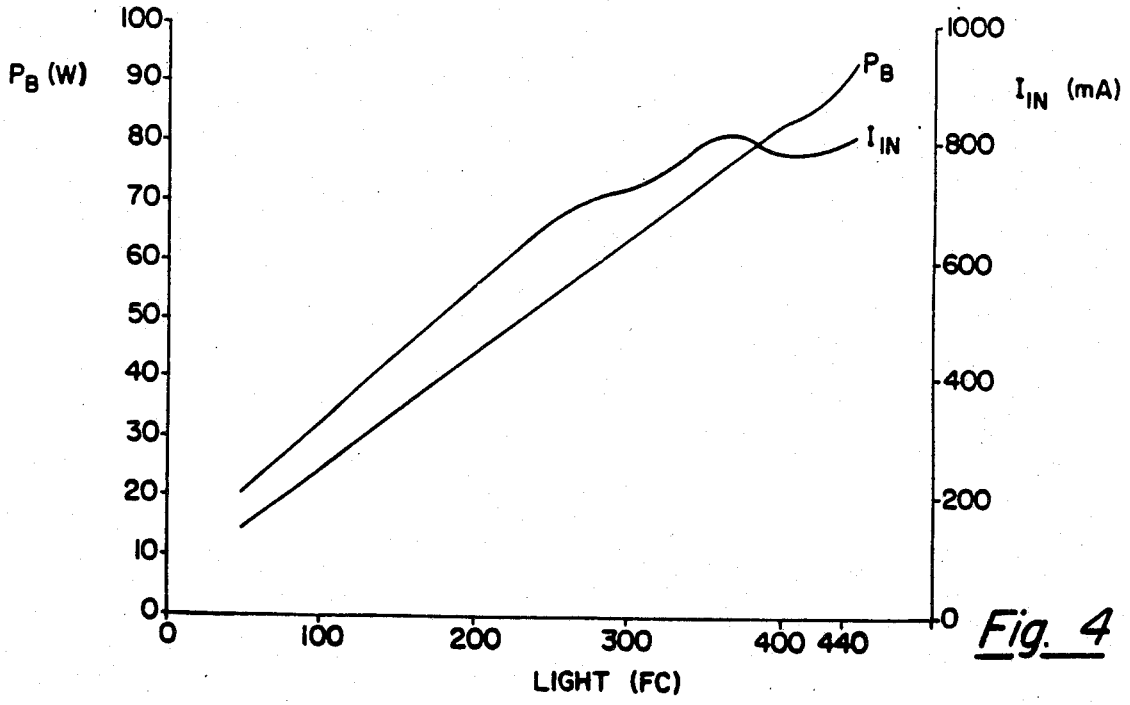
FIG. 4 is a graphical representation showing ballast power and ballast input current as a function of fluorescent lamp light output over the dimming range.

FIG. 4 illustrates the basically linear decrease in lamp light output, power and current during the dimming from approximately 100% to 10% of lamp output.

I claim:

1. A dimming system for a fluorescent tube wherein the operation of the fluorescent tube is maintained, said dimming system comprising:

line and neutral source terminals for connection to a source of sinusoidal power;

load terminals for connection to a load having at least one fluorescent tube;

switch means connected to said source terminals and to said load terminals for controlling the supply of power to said load terminals;

switch control means connected to said switch means switching said switch thereby energizing and deenergizing said load terminals to modulate the amount of sinusoidal power input connected between said source and said load on a time ratio variable basis in order to supply a variable amount of power to said load terminals wherein said modulation varies the power input to said load between full power and a finite reduced amount; and transformer means having a primary winding connected across said source terminals between said source terminals and said switch means and a secondary winding connected between the neutral source terminal and said switch means.

2. A dimming system for a fluorescent tube wherein the operation of the fluorescent tube is maintained said dimming system comprising:

source terminals for connection to a source of sinusoidal power, said source terminals comprising a line terminal and a neutral terminal;

load terminals for connection to a load having at least one fluorescent tube;

switch means connected to said source terminals and to said load terminals for controlling the supply of power to said load terminals;

transformer means having a primary winding connected across said source terminals between said source terminals and said switch means and a secondary winding connected between the neutral source terminal and said switch means;

switch control means connected to said switch means switching said pair of switches on a time ratio variable basis.

3. The dimming system of claim 2 wherein said switches are logic gate controlled such that only one of the switches may be closed at a time.

4. The dimming system of claim 2 wherein said switch control means further comprises:

a phase locked loop oscillator means connected to said source of sinusoidal power for providing an output signal which is a harmonic of the frequency of said sinusoidal power;

logic means connected to the output of said phase locked loop for providing pulsed complementary output signals at said harmonic frequency having a variable pulse width;

a pair of logic coupler means for separately coupling said complementary outputs to each of said switch means for operating said switches;

dimming control means for modulating the relative durations of the complementary outputs of said logic means for controlling the ON and OFF duration of said switches.

5. The dimming system of claim 4 wherein said dimming control means is a variable resistor.

6. The dimming system of claim 4 wherein said logic means is a one shot.

7. The dimming system of claim 4 wherein said switch control means further comprises delay circuit means between each said complementary outputs of said logic means and said coupling means to prevent the simultaneous occurance of output signals which turn said switches ON.

* * * * *